United States Patent [19]

Marzoli et al.

[11] Patent Number: 4,944,071

[45] Date of Patent: Jul. 31, 1990

[54] TEXTILE FIBRE BALE BREAKER

[76] Inventors: Pietro B. Marzoli; Mario Mascheretti, both of Via Durante, 1, Palazzolo sull'Oglio (BS), Italy

[21] Appl. No.: 426,785

[22] Filed: Oct. 25, 1989

[30] Foreign Application Priority Data

Jun. 1, 1989 [IT] Italy ..... 20724 A/89

[51] Int. Cl.[5] ..... D01G 7/12

[52] U.S. Cl. ..... 19/80 R; 19/97.5

[58] Field of Search ..... 19/80 R, 81, 83, 86, 19/90, 97.5

[56] References Cited

U.S. PATENT DOCUMENTS 4,771,513 9/1988 Pinto et al. ..... 19/81

FOREIGN PATENT DOCUMENTS

| | | | |
|---|---|---|---|
| 0221306 | 5/1987 | European Pat. Off. | 19/80 R |
| 0223741 | 7/1985 | German Democratic Rep. | 19/80 R |
| 1388480 | 9/1985 | U.S.S.R. | 19/97.5 |
| 838793 | 6/1960 | United Kingdom | 19/80 R |
| 2185759 | 7/1987 | United Kingdom | 19/80 R |

*Primary Examiner*—Werner H. Schroeder
*Assistant Examiner*—John J. Calvert
*Attorney, Agent, or Firm*—Bucknam and Archer

[57] ABSTRACT

The bale-breaker comprises a movable carriage which can slide along a supporting frame adapted for supporting the fibre bales with a slanted axis, the movable carriage bearing a take up carriage the longitudinal axis of which is perpendicular to the bale layer surface.

5 Claims, 1 Drawing Sheet

TEXTILE FIBRE BALE BREAKER

BACKGROUND OF THE INVENTION

The present invention relates to a bale-breaker for opening textile fibre bales and adapted for removing the textile material in a direction perpendicular to the bale layers.

As is known, the processing method for processing and spinning cotton fibres comprise a first cotton bale opening step and a second step in which cotton staples are removed from the compact bale laps.

This staple removing operation is carried out by suitable staple take up devices, or bale breakers which are usually provided with a take up carriage which is driven near the cotton bales for removing cotton therefrom.

However, since the bales have a different height, it is difficult to obtain, by removing cotton from the bale tops, a homogeneous fibre blend.

Moreover, the bales may have a comparatively great vertical height and must be properly supported in order to hold them in a stationary condition.

Accordingly, all of the apparatus which remove cotton from the tops of the bales, i.e. along a direction parallel to the layers of the bales, are rather complex construction-wise because of the requirements of evenly remove the cotton laps while properly supporting the bales in a vertical attitude.

Apparatus are also known which are designed for removing cotton from the front portion of the bale, which apparatus are usually arranged on a slanted panel so as to fall by gravity against the cotton removing reels, which are displaced with a parallel relationship to the bales.

This approach is for example disclosed in the DE 12 67 151 patent to Hergeth. In this apparatus, however, the pressure of the bales on the removing reels will affect the removal depth, depending on the bale weight.

Yet another drawback of the thus constructed apparatus is that a lot of labour is required to properly arrange the bales with respect to the apparatus.

SUMMARY OF THE INVENTION

Accordingly, the present invention sets out to overcome the above mentioned drawbacks, by providing a bale breakers for opening or breaking textile fibre bales which operates to remove the textil material in a direction perpendicular to the bale layers or laps and which is adapted for simultaneously removing fibres from the ends and centre of said bales.

Within the scope of the above mentioned aim, a main object of the present invention is to provide such a bale breakers in which the reel pressure is independent from the bale weight.

Another object of the invention is to provide such a bale breaker which facilitates the arrangement of the bales in an adjoining position.

According to one aspect of the present invention, the above mentioned aim and objects, as well as yet other objects, which will become more apparent hereinafter, are achieved by a bale breaker so designed and arranged as to remove textile fibres in a direction perpendicular to a bale lap, characterized in that said bale breaker comprises a movable carriage sliding along a bearing frame of trapezoidal cross-section and supporting a plurality of slanted bales, said movable carriage moving along outer faces of said bales and carrying a fibre removing carriage having a longitudinal axis which is perpendicular to said bale laps.

DESCRIPTION OF THE DRAWINGS

Further characteristics and advantages of the bale-breaker according to the present invention will become more apparent from the following detailed description of a preferred embodiment thereof, which is illustrated, by way of an indicative but not limitative example, in the accompanying drawings, in which.

DESCRIPTION OF THE PREFERRED EMBODIMENT

Figure 2:
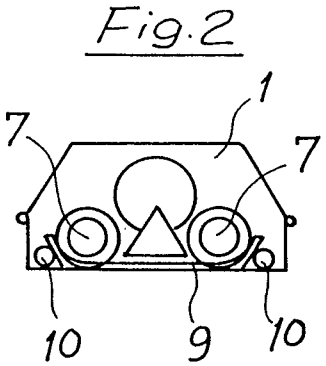
FIG. 2 is a cross-sectional view of the textile material removing or take up carriage included in the bale breaker according to the invention.
Figure 1:
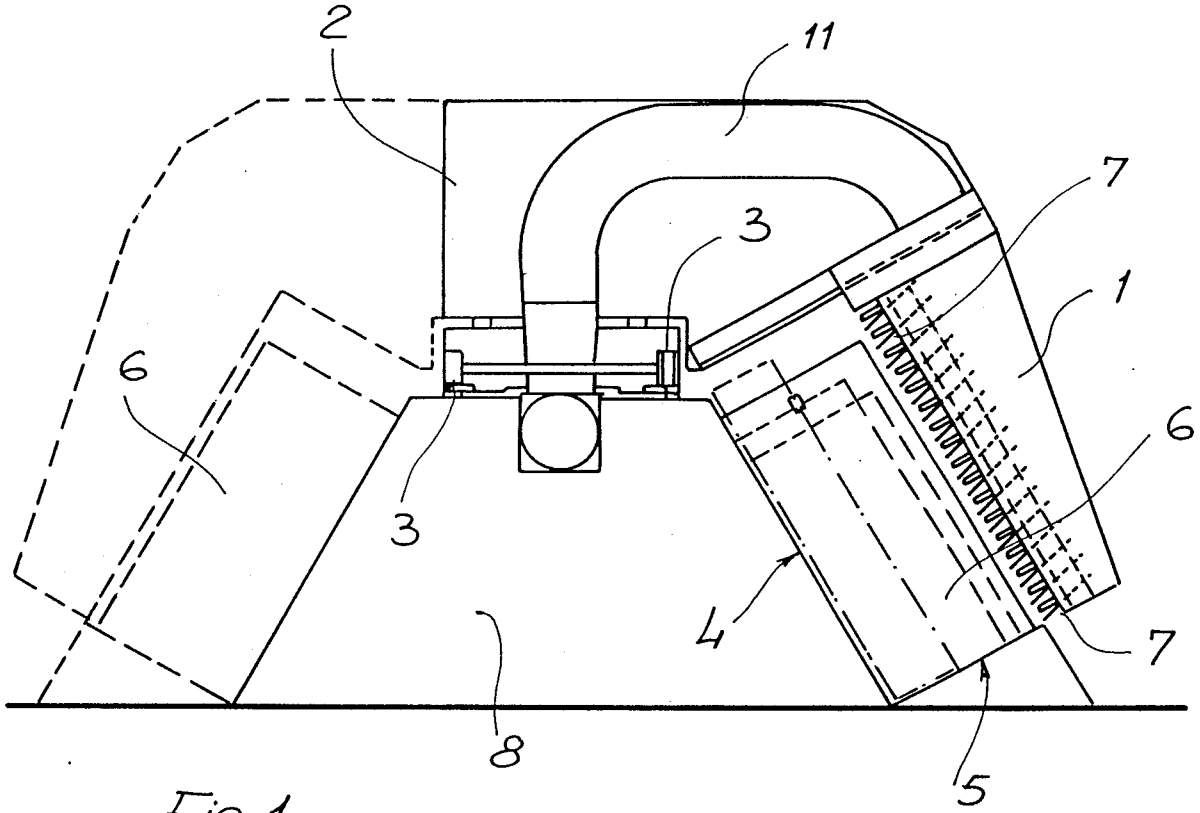
FIG. 1 is a schematic cross-sectional view illustrating the bale braker according to the present invention.

With reference to the figures of the accompanying drawings, the bale breaker according to the present invention comprises a take up or removing carriage, of substantially conventional structure, but mounted on a slanted axis with respect to a movable carriage 2 which is provided for sliding, with an even speed, along rail members 3, as driven by suitable driving means, not specifically shown.

More specifically the longitudinal axis of the removing carriage is respectively parallel and perpendicular to a pair of slanted planes or panels 4 and 5 which are mutually perpendicular and jointly define a supporting structure for the cotton bales 6.

In this connection it should be pointed out that the panel 4 forms, with a horizontal line, an angle which can be varied in a broad range, from 15° to 75° and specifically designed for providing the bales with a very firm attitude.

Thus, owing to the disclosed arrangement, the reels 7 will remove the cotton staples from the bale 6 laps, that is in a normal direction to the cotton staples pressing direction.

Accordingly, the removal will be substantially homogeneous along the overall height of the bales, since, for each passage of the carriage 1, much or more pressed cotton portions will be removed, depending on their positions with respect to the height of said bales.

Moreover the bale profile facing the removing carriage will have a more even pattern since the cross-sections of the bales do not differ in any appreciable degree.

Advantageously, the bales are supported on two opposite rows by means of a trapezoidal supporting structure 8 on the top base of which there are mounted the rails 3.

As shown, the removing carriage 1 comprises pressing pads 9 therewith corresponding gripping rollers 10 cooperate, and further includes a sucking duct 11 for conveying the cotton staples removed by the reels 7 to other processing apparatus.

In this connection, it should be pointed out the mentioned pads, provided for fitting the cotton staple removing force to the compactness of the cotton material at the several zones of the bales, can also be omitted, since the cotton removal is carried out through the overall height of the cotton bales.

The above disclosed supporting structure, moreover, facilitates the arranging operation of the cotton bales and assures a perfect stability of the bales.

While the invention has been disclosed and illustrated with reference to a preferred embodiment thereof, it should be apparent that the disclosed embodiment is susceptible to several modifications and variations, all of which will come within the spirit and scope of the appended claims.

We claim:

1. A bale breaker so designed and arranged as to remove textile fibres from a textile fibre bale in a direction perpendicular to laps of said bale, said bale breaker comprising a movable carriage sliding along a bearing frame of trapezoidal cross-section and supporting a plurality of slanted bales, said movable carriage being driven for moving along outer faces of said bales and carrying a fibre removing carriage having a longitudinal axis which is perpendicular to said bale laps.

2. A bale breaker according to claim 1, said fibre removing carriage is mounted with a slanted attitude with respect to said movable carriage which is driven for moving with an even speed along rail members.

3. A bale breaker according to claim 1, said longitudinal axis of said removing carriage is respectively parallel and perpendicular to a pair of slanted panels one of which is part of the trapezoidal cross-section and the other perpendicular to said cross-section panel and supporting said bales.

4. A bale breaker according to claim 1, said perpendicular panels form with respect to a horizontal line an angle included in a range of 15° to 75°.

5. A bale breaker according to claim 1, said bales are supported by said trapezoidal bearing frame in two opposite rows, said rail members being applied on said bearing frame at a top face thereof.

* * * * *